US005704188A

United States Patent [19]

Coulis

[11] Patent Number: 5,704,188

[45] Date of Patent: Jan. 6, 1998

[54] POST STRUCTURE

[75] Inventor: Mark L. Coulis, Brunswick, Ohio

[73] Assignee: Associated Materials, Inc., Akron, Ohio

[21] Appl. No.: 477,815

[22] Filed: Jun. 7, 1995

[51] Int. Cl.[6] ..... E04C 3/30; E04H 17/20

[52] U.S. Cl. ..... 52/736.3; 52/396.06; 52/688; 52/732.3; 52/721.4; 236/59; 236/65; 248/156; 248/530

[58] Field of Search ..... 52/736.1, 736.2, 52/721.4, 732.2, 732.3, 687, 689, 688, 165, 396.06; 256/19, 59, 65, 10, 51; 403/327, 378; 248/156, 530, 531, 512; 24/27, 551

[56] References Cited

U.S. PATENT DOCUMENTS

| | | | |
|---|---|---|---|
| 261,281 | 7/1882 | Van Dorn . | |
| 321,717 | 7/1885 | Hamilton . | |
| 849,922 | 4/1907 | Scofield | 52/687 |
| 870,554 | 11/1907 | Gargett | 256/51 |
| 1,024,858 | 4/1912 | Kissinger et al. | 256/59 |
| 2,450,345 | 9/1948 | Kervin . | |
| 2,519,612 | 5/1950 | Tuttle | 248/530 |
| 3,104,875 | 9/1963 | Doyle . | |
| 3,115,726 | 12/1963 | Sayles | 52/589 X |
| 3,196,495 | 7/1965 | Owen . | |
| 3,714,750 | 2/1973 | Pallotto . | |
| 3,825,229 | 7/1974 | Bartlett et al. . | |
| 3,910,561 | 10/1975 | Fornells . | |
| 4,038,802 | 8/1977 | Bajorek et al. . | |
| 4,060,222 | 11/1977 | Pitkin et al. . | |
| 4,190,999 | 3/1980 | Hampton | 52/687 |
| 4,249,354 | 2/1981 | Wynn | 52/688 X |
| 4,516,756 | 5/1985 | Beatty . | |
| 4,792,254 | 12/1988 | Platten . | |
| 4,854,548 | 8/1989 | Wylie . | |
| 4,958,807 | 9/1990 | Wylie . | |
| 5,255,899 | 10/1993 | Von Grozny | 256/65 X |
| 5,273,258 | 12/1993 | Bedics . | |
| 5,287,869 | 2/1994 | Wu . | |
| 5,291,703 | 3/1994 | Ziegler | 52/156 X |
| 5,308,085 | 5/1994 | Koole . | |

*Primary Examiner*—Carl D. Friedman
*Assistant Examiner*—Winnie Yip
*Attorney, Agent, or Firm*—Banner & Witcoff, Ltd.

[57] ABSTRACT

A post structure which includes a support pole, a casing, and spring clips for securing the casing to the pole. The spring clips each include a spiral portion which grips the pole, and arms which project outward to engage the inner sidewalls of the casing. The spring clips are constructed to permit the casing to be moved downwardly over the spring clips during installation. However, the spring clips effectively anchor the casing to the pole to prevent any upward movement of the casing for removal.

34 Claims, 5 Drawing Sheets

POST STRUCTURE

FIELD OF THE INVENTION

The present invention pertains to a post, and in particular a reinforced plastic fence post.

BACKGROUND OF THE INVENTION

Installation of a fence having plastic fence posts requires excavation of a series of bores across the desired terrain. The bores are typically 6–9 inches in diameter and 36–42 inches in depth. A plastic post is set in each bore and braced in a plumbed position. Concrete is then poured around the post to form a solid foundation. This process is not only time consuming, but also potentially damaging to the surrounding landscape due to the equipment ordinarily required. Moreover, large amounts of excess dirt are generated as a result of the required excavation and pouring of concrete, which, in turn, creates disposal problems.

A reinforced plastic post includes a rigid support pole which is encased by a plastic housing. See, for instance, U.S. Pat. Nos. 4,958,807 to Wylie, 4,516,756 to Beatty, 4,060,222 to Pitkin et al., and 3,910,561 to Fornells. However, in none of these patents is the plastic housing anchored to the support pole to prevent its removal. Further, the support poles of the Wylie, Beatty, and Fornells patents are sunk in concrete in the same way as an ordinary plastic post. Hence, these posts suffer the same installation problems as a plastic post.

SUMMARY OF THE INVENTION

The present invention is directed to a reinforced plastic post comprising a rigid support pole, a plastic casing and spring clips for securing the casing to the pole. The spring clips each include a spiral portion which grips the pole and arms which project outward to engage the inner sidewalls of the casing. The spring clips are constructed to permit the casing to be moved downwardly over the spring clips during installation. However, the spring clips effectively anchor the casing to the pole to prevent any upward movement of the casing for removal.

Preferably, the support pole is driven directly into the ground without excavation or the pouring of concrete. In this way, a strong reinforced plastic fence post can be installed in a quick and easy manner. This Construction also avoids the generation of excess dirt and the marring of the surrounding landscape.

DETAILED DESCRIPTION OF THE PREFERRED EMBODIMENTS

The present invention pertains to a post structure, particularly suited for use as a reinforced plastic fence post 10.

In the preferred embodiment, post 10 comprises a support pole 12, a casing 14, and a plurality of spring clips 16 (FIGS. 1–6). Casing 14 is mounted to support pole 12 by spring clips 16.

Figure 1:
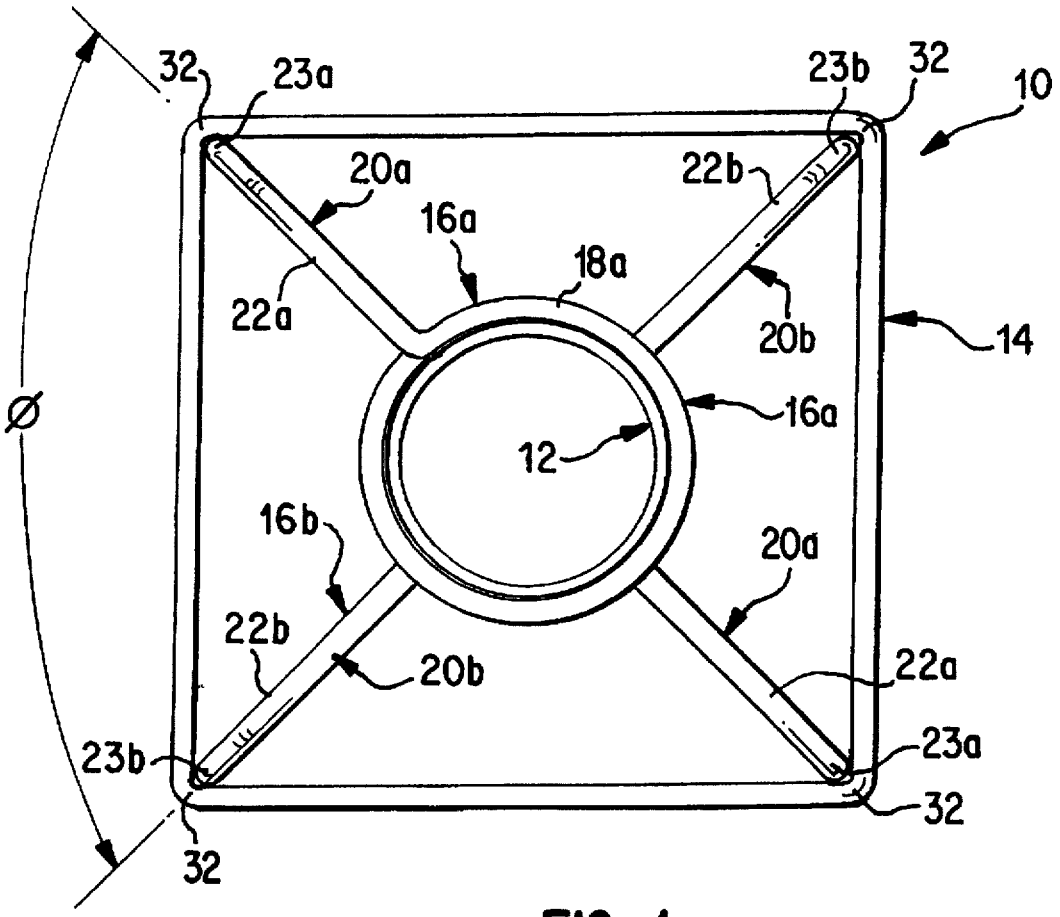
FIG. 1 is a top view of a reinforced plastic post in accordance with the present invention.
Figure 4:
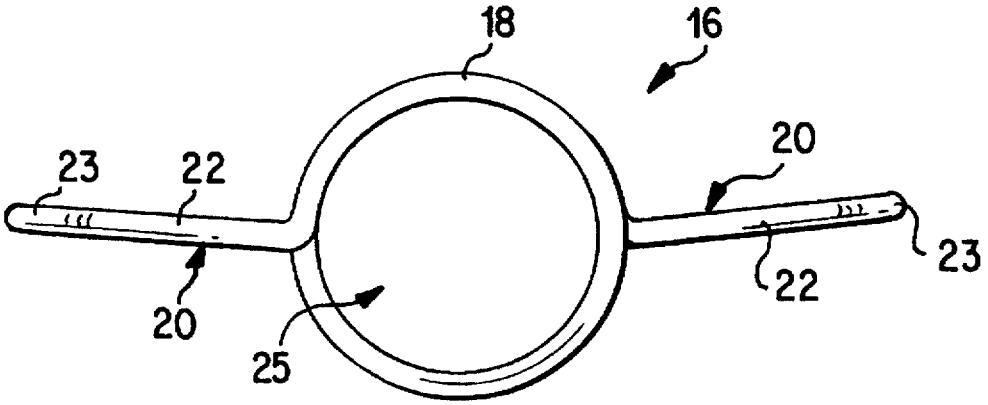
FIG. 4 is a top plan view of the spring clip.
Figure 2:
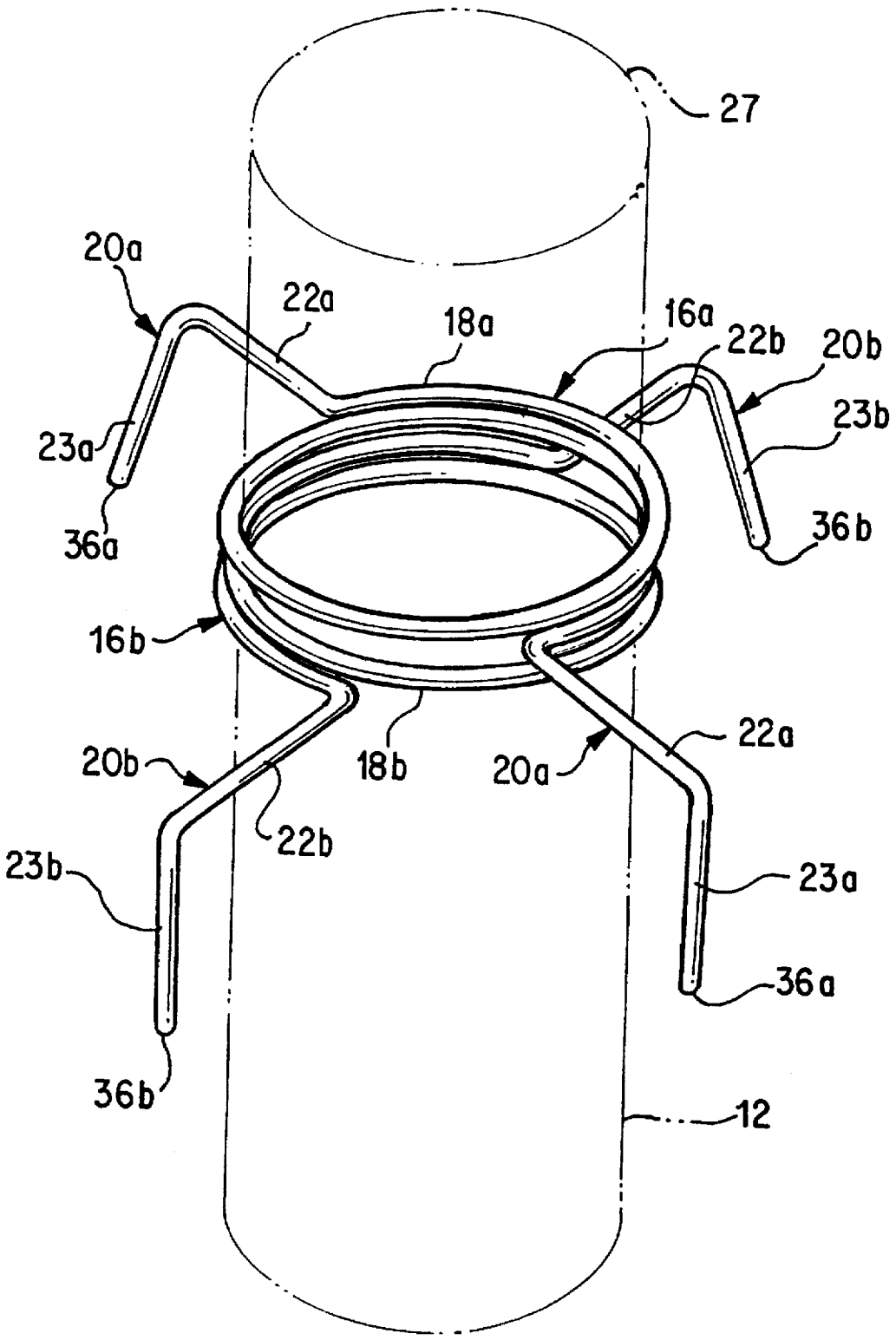
FIG. 2 is a perspective view of a pair of spring clips as secured to a support pole (which is shown in phantom).
Figure 6:
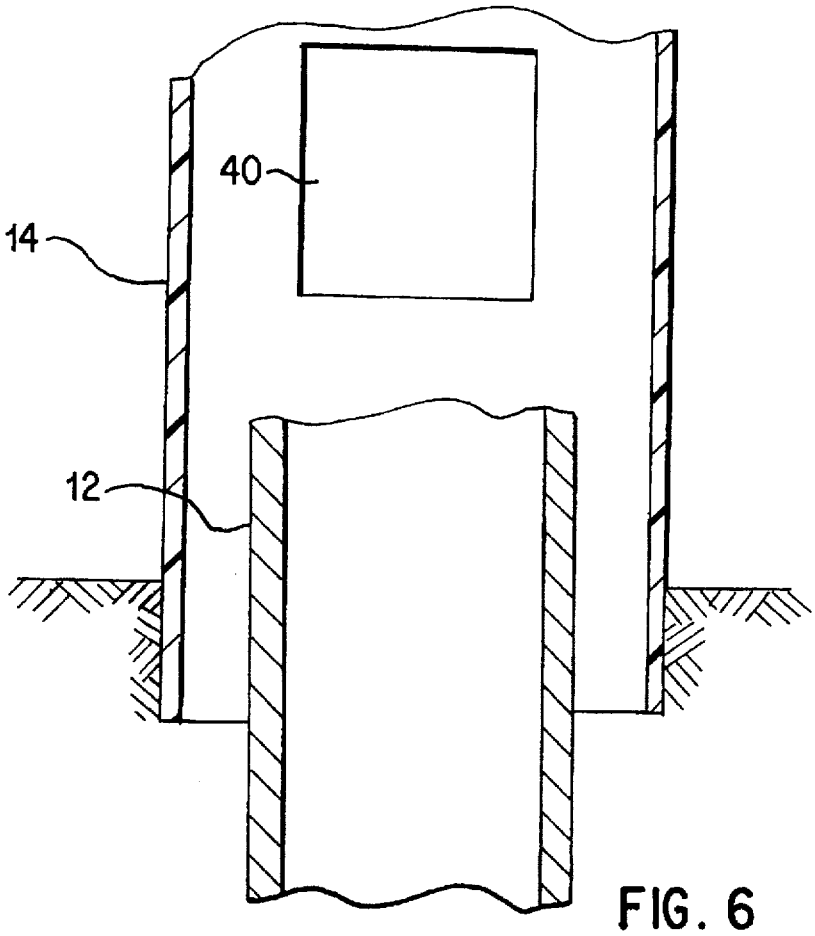
FIG. 6 is a partial sectional view an assembled post.

Support pole 12 is an elongate rigid member, preferably composed of steel or other metals (FIGS. 1, 2 and 6). Support pole 12 is adapted to be forcibly driven into the ground without excavation. Accordingly, installation of a fence using posts in accordance with the present invention avoids the generation of excess dirt. The pole may be manually driven into the ground with a sledge hammer, or driven with a power driving device. Typically, the pole is driven into the ground to a depth of about 30–42 inches depending on the type of soil and the support needed for the fence. Nonetheless, support pole 12 can be sunk in concrete if desired. In the preferred construction, the support pole has a wall thickness of about 0.063 inch, and an outer diameter of about 2 inches. Nevertheless, these dimensions may be varied widely, so long as the requisite strength and support are provided.

Each spring clip 16 is formed as an elongate unitary member composed of mild steel or other material having the requisite strength and resiliency (FIGS. 1–5). More specifically, spring clip 16 has a central portion 18 which is formed in a tight spiral. Spiral portion 18 defines a circular opening 25 adapted to receive and grip support pole 12. The spiral portion extends preferably about 540° before terminating in a pair of arms 20. Opening 25 is designed to be slightly smaller than the outside diameter of pole 12. As one example, opening 25 can have unflexed inner diameter which is 0.01 inches less than the outer diameter of support pole 12. In this way, spring clip 16 is able to grip pole 12 with a snug fit. During installation, spring clips 16 are fit over the top 27 of pole 12 and slid downward to the desired location (FIG. 2). In view of the snug fit, spring clips 16 are spread apart slightly during installation in order to facilitate their positioning on support pole 12. Expansion of spring clips 16 can be accomplished by manually grasping arms 20 and applying a spreading force to spiral portion 18.

Figure 3:
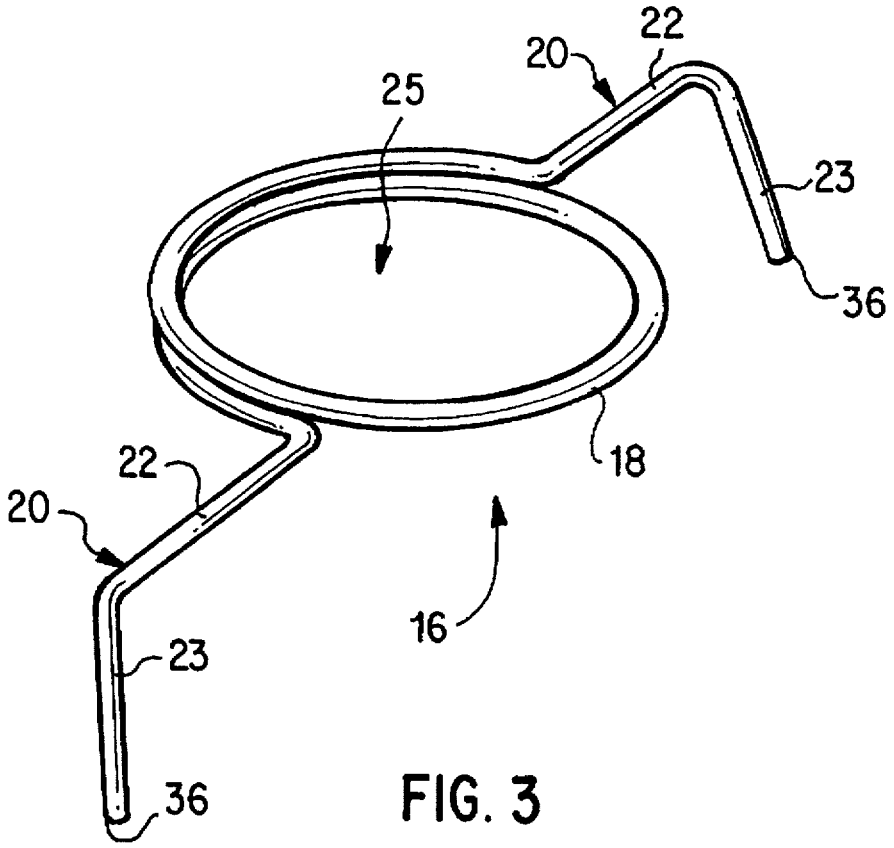
FIG. 3 is a perspective view of a spring clip.
Figure 5:
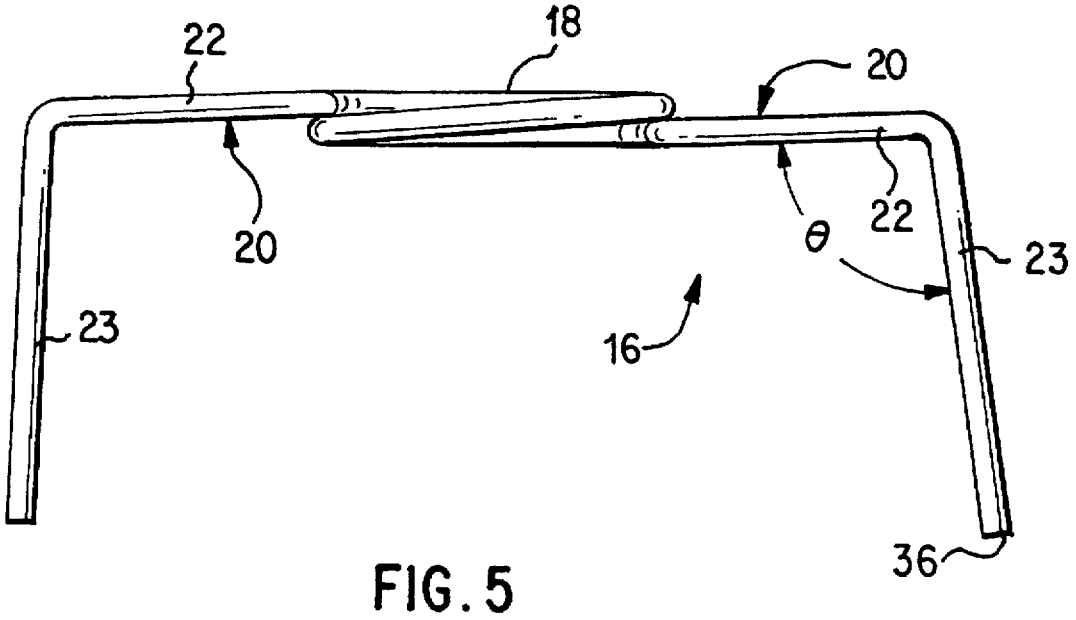
FIG. 5 is a side elevational view of the spring clip.

Arms 20 project radially outward from opposite ends of spiral portion 18 to engage inner surfaces of casing 14 (FIG. 1). Each arm 20 generally has a dogleg configuration and includes a proximal segment 22 and a distal segment 23 (FIGS. 2–3 and 5). Proximal segments 22 extend radially outward from spiral portion 18 in a substantially horizontal orientation. In an unflexed state, distal segments 23 are inclined downward at an angle θ which is greater than 90° relative to proximal segment 22 (FIG. 5). In the preferred embodiment, distal segments project downwardly in an unflexed state at an angle θ of about 95°.

In the preferred embodiment, spring clips 16 are mounted to support pole 12 in pairs (FIG. 2). As seen in FIG. 2, spring clips **16*a*, 16*b* are placed adjacent each other on support pole 12. In this arrangement, arms 20*a* of spring clip 16*a* are offset from arms 20*b* of spring clip 16*b* by an angle ø of about 90°. Accordingly, one arm 20 can be received into each corner 32 of casing 14. One pair of spring clips is preferably located close to top 27 of pole 12. The other pair of spring clips is preferably located close to the ground. Accordingly, two arms engage each corner 32 of casing 14. Nevertheless, other spring clip arrangements could be employed. For example, additional pairs of spring clips could be included for long poles to provide extra support. Alternatively, fewer springs could be used for smaller sized posts or posts used in less strenuous environments. The spring clips could also be spaced apart along the length of support pole 16**, instead of being grouped in pairs near the top and bottom of the pole.

Casing 14 is a hollow member adapted to be received over support pole 12 and spring clips 16. Preferably, casing 14 has a rectangular configuration with inner walls 34 spaced uniformly from support pole 12. In one example, the midpoints of walls 34 are radially spaced from support pole 12 by about 1½ inches. Of course, this spacing is subject to wide variations. Casing 14 is preferably composed of a polyvinyl chloride (PVC) material; although other plastics could be used. Moreover, though casing 14 is preferably rectangular, it could have a wide variety of configurations including circular, polygonal, or irregular.

During installation, casing 14 is slipped downward over top of support pole 12 and the attached spring clips 16. As the casing is moved downward, the bottom edge 38 of casing 14 engages against ends 36 of the uppermost spring clips 16 and flexes distal segments 23 inwardly. Due to this inward flexing, arms 20 (if arranged slightly out of their proper position) automatically seek the locations of least resistance, which in this case are corners 32. Despite the snug fit of spring clips 16 on support pole 12, the spring clips can rotate about the support pole to position arms 20 in corners 32. With the casing positioned over spring clips 16, distal segments 23 are flexed radially inward to an anchoring position. In the preferred construction, distal segments 23 are bent inward until the angle θ is about 90°–92° (FIG. 5). Nonetheless, the angular extension and degree of flexing can be varied.

Once casing 14 is installed, spring clips 16 are able to effectively anchor casing 14 to support pole 12. More specifically, due to the outward bias and angular orientation of distal segments 23, any upward movement of casing 14 causes ends 36 of arms 20 to dig into the inner surface of casing 14. Upward movement of the casing also tends to force arms 20 radially inward to further tighten the grip of the spring clips on the support pole. The tighter grip by spring clips 16 on pole 12, ensures that the spring clips will not slide upwardly. As a result, casing 14 cannot be removed without damaging the spring clips, the casing or both.

Casing 14 includes a series of vertically spaced holes 40 on opposite sides which are adapted to receive therein the ends of cross rails (not shown) for the fence (FIG. 6). To accommodate the cross rails, holes 40 on one post 10 need to be substantially aligned with the holes provided on an adjacent post (i.e., within the range of acceptable grades). If one casing is angularly offset relative to the casing of an adjacent post, the casing can be manually rotated (with spring clips 16) about the support pole to its proper position. Once the angular orientation of casing 14 has been set, the casing is preferably driven a few inches into the ground. The specific depth of the casing into the ground is variable to permit proper placement of holes 40 as needed to support the cross rails. Additionally, embedding the bottom edge 38 of casing 14 in the ground prevents inadvertent turning of the casing.

Figure 7:
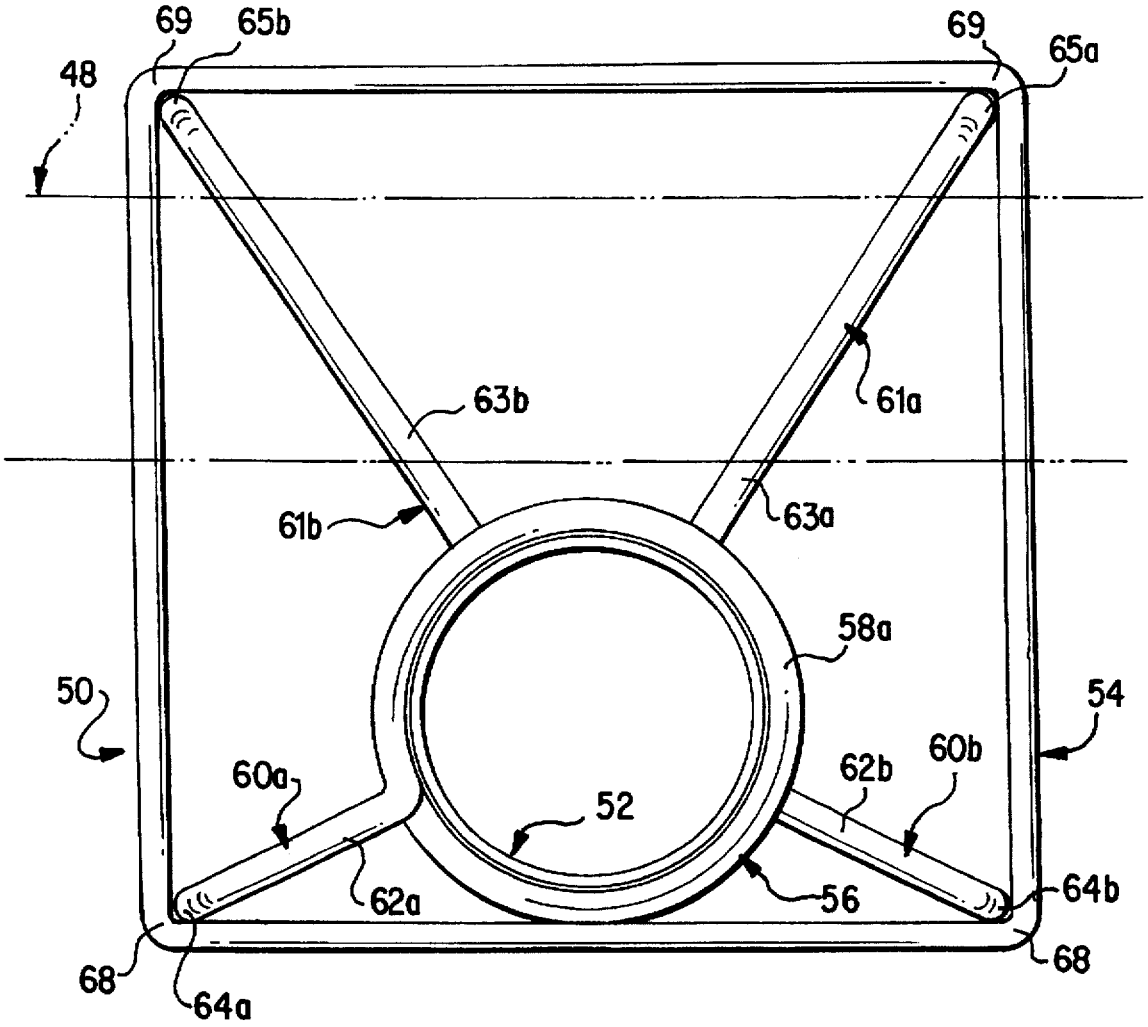
FIG. 7 is a top view of an alternative post construction.
Figure 8:
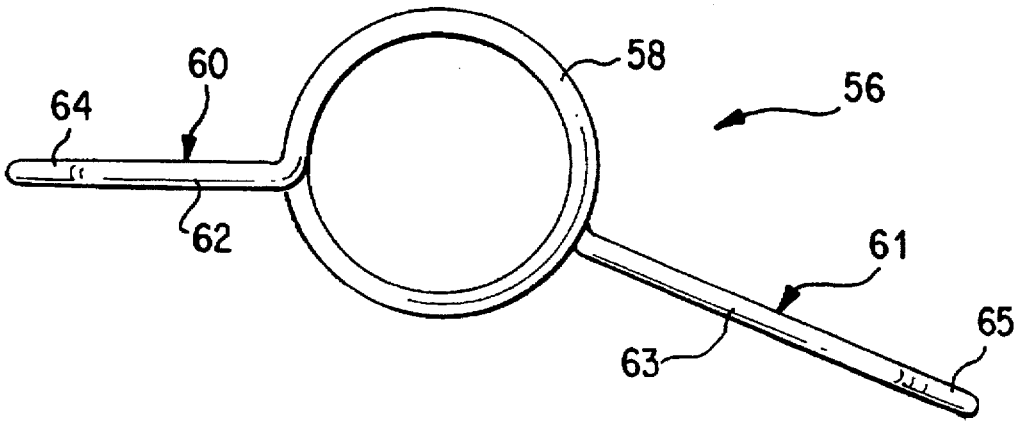
FIG. 8 is a top plan view of an alternative spring clip.

In the construction of certain fences, especially in agricultural environments, long cross rails 48 (e.g., 12–16 feet in length) are used to interconnect three or more posts 50 (FIGS. 7–8). In this alternative embodiment, support pole 52 is positioned off center relative to casing 54 to provide sufficient clearance for the elongate cross rails 48 to be passed through the casing. To effect such an off-center mounting, spring clips 56 are formed to be asymmetrical.

Each spring clip 56 includes a spiral portion 58 which defines an opening 59 for receiving and gripping support pole 52. In the preferred construction, spiral portion 58 is turned a distance of about 510°; although this value is subject to wide variation depending on the size and shape of casing 54. However, to prevent inadvertent release of casing 54, spiral portion 58 should extend at least 360° around support pole 12.

Spring clips **56*a*, 56*b* are preferably arranged in pairs at the top and bottom of support poles 52. Arms 60*a*, 61*a*, 60*b*, 61*b* project radially outward from spiral portions 58 to engage the inner surface of casing 54. As with spring clips 12, each arm 60*a*, 61*a*, 60*b*, 61*b* of spring clips 60*a*, 60*b* has a dogleg configuration and includes a proximal segment 62*a*, 63*a*, 62*b*, 63*b* and a distal segment 64*a*, 65*a*, 64*b*, 65*b*. In spring clips 60*a*, 60*b*, proximal segments 62*a*, 63*a*, 62*b*, 63*b* have different lengths in order to reach corners which are spaced a different distance from support pole 12. More specifically, segments 62*a*, 62*b* are shorter to engage the closer corners 68, whereas segments 63*a*, 63*b* have extended lengths to reach the farther corners 69. Distal segments 64*a*, 65*a*, 64*b*, 65*b* are generally identical to one another and the same as distal segments 23 of spring clips 16**.

The holes for receiving cross rails 48 are formed off center in opposite sides of casing 54. In particular, the holes are formed adjacent to corners 69 so that cross rails 48 avoid support pole 12. In this way, extended cross rails 48 can pass entirely through casing 54 to link at least three posts together.

The above-discussion concerns the preferred embodiments of the present invention. Various other embodiments as well as many changes and alterations may be made without departing from the spirit and broader aspects of the invention as defined in the claims.

I claim:

1. A post comprising:

a support pole having one end embedded in a support medium and a remaining portion extending above the support medium;

a casing surrounding said support pole; and at least one clip received within said casing for securing said casing to said support pole, said clip having a one-piece construction including a mounting portion having a spiral configuration to grip said support pole, and a plurality of outwardly projecting arms extending in different directions to engage and hold said casing in an assembled position on said support pole, said clip being the sole component for interconnecting and supporting the casing to the remaining portion of said support pole.

2. A post in accordance with claim 1, wherein each said arm includes a distal end which projects generally in the direction of the support medium and is biased outwardly against an inner surface of said casing.

3. A post in accordance with claim 1, in which said arms of said clip have different lengths.

4. A post in accordance with claim 1, in which said mounting portion extends in a spiral around said support pole for at least 360 degrees.

5. A post in accordance with claim 1, in which said mounting portion extends in a spiral around said support pole for about 450–540 degrees.

6. A post in accordance with claim 1, in which said mounting portion extends in a spiral around said support pole for about 540 degrees.

7. A post in accordance with claim 1, in which a plurality of clips are provided to secure said casing to said support pole.

8. A post in accordance with claim 7, in which said casing includes a first end proximate the support medium and a second end remote from the support medium, and wherein a pair of clips are mounted near the first end of said casing and a pair of clips are mounted near the second end of said casing.

9. A post in accordance with claim 8, in which the arms of each pair of clips are arranged to project radially in different directions.

10. A post in accordance with claim 7, in which said casing has a polygonal configuration with a plurality of corners, and said arms of said clips engage at least a plurality of said corners.

11. A post in accordance with claim 1, in which said casing further includes spaced apart holes for receiving cross rails therein.

12. A post in accordance with claim 1, wherein said support pole and said casing each has a longitudinal axis, and wherein said longitudinal axis of said casing is offset from said longitudinal axis of said support pole.

13. A post in accordance with claim 12, in which opposite sides of said casing each include at least one hole, said holes being offset from said support pole so that a cross rail can pass through said casing.

14. A post in accordance with claim 1, in which said casing is composed of a plastic material.

15. A fence post comprising:

a support pole having a longitudinal axis and one end embedded in a support medium;

a casing surrounding said support pole, said casing having a longitudinal axis that is offset from said longitudinal axis of said support pole, and holes defined in opposite sides of said casing, said holes being offset from said support pole so that a cross rail can pass through said casing; and at least one clip for securing said casing to said support pole.

16. A fence post in accordance with claim 15, in which said clip includes a mounting portion having a spiral configuration to grip said support pole, and a pair of outwardly projecting arms to engage and hold said casing in an assembled position.

17. A fence post in accordance with claim 16, wherein each said arm includes a distal end which projects generally in the direction of the support medium and is biased outwardly against an inner surface of said casing.

18. A fence post in accordance with claim 17, in which said arms of said clip have different lengths.

19. A fence post in accordance with claim 18, in which said mounting portion extends in a spiral around said support pole for at least 360 degrees.

20. A fence post in accordance with claim 15, in which a plurality of clips are provided to secure said casing to said support pole.

21. A fence post in accordance with claim 15, in which said casing is composed of a plastic material.

22. A post comprising:

a support pole having one end embedded in a support medium;

a casing surrounding said support pole; and at least one clip for securing said casing to said support pole, said clip including means for permitting movement of said casing relative to said clip in a direction toward the support medium and preventing movement of said casing away from the support medium.

23. A post in accordance with claim 22, in which said clip includes a mounting portion having a spiral configuration to grip said support pole, and a pair of outwardly projecting arms to engage and hold said casing in an assembled position.

24. A post in accordance with claim 23, wherein each said arm includes a distal end which projects generally in the direction of the support medium and is biased outwardly against an inner surface of said casing.

25. A post in accordance with claim 23, in which said mounting portion extends in a spiral around said support pole for at least 360 degrees.

26. A post in accordance with claim 22, in which said casing is composed of a plastic material.

27. A post in accordance with claim 22, in which a plurality of clips are provided to secure said casing to said support pole.

28. A spring clip for securing a casing to a support pole comprising a one piece elongate member formed to define a medial mounting portion having a spiral configuration about an axis to enable gripping of a support pole, and a plurality of outwardly projecting arms adapted to engage and hold said casing in an assembled position, each said arm including a first segment projecting generally radially from said mounting portion and a second segment projecting from said first segment in the same general direction as said axis, said second segments each extending generally in the same direction from said first segments.

29. A spring clip in accordance with claim 28, in which said arms of said spring clip have different lengths.

30. A spring clip in accordance with claim 28, in which said mounting portion extends in a spiral for at least 360 degrees.

31. A spring clip in accordance with claim 28, in which said second segment projects from said mounting portion at an angle of greater than 90°.

32. A fence post comprising:

a support pole having one end embedded in a support medium and a remaining portion extending above the support medium;

a casing surrounding said support pole;

at least one clip received within said casing for securing said casing to said support pole, said clip including a mounting portion having a spiral configuration to grip said support pole, and a pair of outwardly projecting arms to engage and hold said casing in an assembled position on said support pole, said clip being the sole component for interconnecting and supporting the casing to the remaining portion of said support pole; and means for securing cross rails to said post.

33. A spring clip in accordance with claim 28, in which said spiral configuration is resiliently expandable in a radial direction to enable placement of the clip over a pole.

34. A post comprising:

a support pole having one end embedded in a support medium;

a casing surrounding said support pole; and at least one clip for securing said casing to said support pole, said clip including non-cutting means for gripping said support pole, and means for permitting movement of said casing toward the support medium and preventing movement of said casing away from the support medium.

* * * * *